US009588494B2

(12) United States Patent
Speichinger

(10) Patent No.: US 9,588,494 B2
(45) Date of Patent: Mar. 7, 2017

(54) HOLDING AND INDEXING DEVICE FOR TIMEPIECES

(71) Applicant: RICHEMONT INTERNATIONAL S.A., Villars-sur-Glane (CH)

(72) Inventor: Ferdinand Speichinger, Neuhausen am Rheinfall (CH)

(73) Assignee: Richemont International S.A., Villars-Sur-Glane (CH)

( * ) Notice: Subject to any disclaimer, the term of this patent is extended or adjusted under 35 U.S.C. 154(b) by 178 days.

(21) Appl. No.: 14/526,133

(22) Filed: Oct. 28, 2014

(65) Prior Publication Data

US 2015/0117163 A1 Apr. 30, 2015

(30) Foreign Application Priority Data

Oct. 30, 2013 (CH) ..... 1827/13

(51) Int. Cl.
*G04B 27/08* (2006.01)
*G04B 19/28* (2006.01)
(Continued)

(52) U.S. Cl.
CPC ..... *G04B 27/08* (2013.01); *G04B 3/041* (2013.01); *G04B 19/18* (2013.01); *G04B 19/283* (2013.01); *G04B 27/002* (2013.01); *G04B 37/10* (2013.01)

(58) Field of Classification Search
CPC ..... G04B 3/04; G04B 18/00; G04B 18/003–18/08; G04B 27/00–27/008; G04B 27/02; G04B 27/08
(Continued)

(56) References Cited

U.S. PATENT DOCUMENTS 3,548,588 A 12/1970 Piquerez
5,742,565 A * 4/1998 Cuinet ..... G04B 27/08 368/190
(Continued)

FOREIGN PATENT DOCUMENTS

CH 486 728 9/1969
CH 495 000 4/1970
(Continued)

OTHER PUBLICATIONS

Machine translation of CH706221.*

*Primary Examiner* — Amy Cohen Johnson
*Assistant Examiner* — Jason Collins
(74) *Attorney, Agent, or Firm* — Christiansen Fonder Dardi, PLLC

(57) ABSTRACT

A holding and indexing device for integration in a setting device of timepieces, including a fixedly-attached bushing, an axially-displaceable and rotatable shaft mounted within the bushing, a transmission element attached to the shaft end directed into the interior of the timepiece and allowing the drive of a timepiece part in the interior, and a resilient element exerting a preload force in the axial direction of the shaft. The device additionally includes an indexing ring attached to the shaft in an axially-sliding manner and having an indexing toothing. The transmission element, on a side face directed towards the ring, includes a side toothing engaged with the indexing toothing due to the force of the resilient element. In at least one direction of rotation of the shaft, applying force onto the indexing ring causes disengagement of the indexing and side toothings, thus allowing a position indexing of the timepiece part.

22 Claims, 7 Drawing Sheets

(51) Int. Cl.

| | |
|---|---|
| ***G04B 27/00*** | (2006.01) |
| ***G04B 3/04*** | (2006.01) |
| ***G04B 19/18*** | (2006.01) |
| ***G04B 37/10*** | (2006.01) |

(58) Field of Classification Search
USPC ..... 368/185
See application file for complete search history.

(56) References Cited

U.S. PATENT DOCUMENTS

| | | | | |
|---|---|---|---|---|
| 6,799,886 | B2 | 10/2004 | Carrard et al. | |
| 7,234,858 | B2 | 6/2007 | Meier | |
| 7,540,655 | B2 * | 6/2009 | Speichinger | G04B 3/041 368/190 |
| 8,366,314 | B2 * | 2/2013 | Marti | G04B 3/045 368/308 |
| 8,439,558 | B2 * | 5/2013 | Pittet | G04B 27/04 368/192 |
| 2002/0167866 | A1 | 11/2002 | Oomori et al. | |
| 2003/0090963 | A1 * | 5/2003 | Schneider | G04B 27/02 368/185 |
| 2004/0042343 | A1 | 3/2004 | Germiquet et al. | |
| 2007/0247978 | A1 | 10/2007 | Carrard et al. | |
| 2008/0151697 | A1 * | 6/2008 | Giauque | G04B 47/065 368/14 |
| 2009/0135682 | A1 | 5/2009 | Hiranuma et al. | |
| 2009/0296534 | A1 * | 12/2009 | Kojima | G04C 3/146 368/185 |
| 2011/0141859 | A1 * | 6/2011 | Papi | G04B 19/283 368/192 |
| 2011/0235476 | A1 | 9/2011 | Hiranuma | |
| 2011/0235477 | A1 | 9/2011 | Hiranuma | |
| 2015/0023142 | A1 * | 1/2015 | Breuillot | G04B 37/103 368/290 |

FOREIGN PATENT DOCUMENTS

| | | | | |
|---|---|---|---|---|
| CH | 544 959 | | 1/1974 | |
| CH | 700 717 | B1 | 10/2010 | |
| CH | 705 862 | A2 | 6/2013 | |
| CH | 706 232 | A2 | 9/2013 | |
| CN | 202677070 | U | 1/2013 | |
| DE | 24 40 248 | A1 | 3/1975 | |
| EP | 0 884 660 | A1 | 12/1998 | |
| EP | 1 420 307 | A1 | 5/2004 | |
| EP | 1 557 728 | A2 | 7/2005 | |
| EP | 1 890 202 | A1 | 2/2008 | |
| EP | 2 166 420 | A2 | 3/2010 | |
| FR | 1 602 849 | | 3/1971 | |
| FR | 2 956 755 | A1 | 8/2011 | |
| FR | 2 956 755 | B1 | 8/2011 | |
| FR | CH 706221 | A2 * | 9/2013 | G04B 19/283 |
| JP | 48-33333 | | 10/1973 | |
| JP | 2010-139399 | A | 6/2010 | |
| WO | WO 02/44818 | A1 | 6/2002 | |
| WO | WO 03/107097 | A2 | 12/2003 | |
| WO | WO 2007/110362 | A2 | 10/2007 | |
| WO | WO 2012/168243 | A1 | 12/2012 | |

* cited by examiner

HOLDING AND INDEXING DEVICE FOR TIMEPIECES

RELATED APPLICATION

The present application claims priority to Swiss Patent Application No. CH 01827/13 filed Oct. 30, 2013, the disclosure of which is hereby incorporated by reference herein in its entirety.

FIELD OF THE INVENTION

The present invention relates to a holding and indexing device. The latter relates in particular to a holding and indexing device for integration in a setting device of timepieces, in particular of wristwatches, wherein the device comprises a fixedly attached bushing, a shaft mounted within the bushing so as to be both axially displaceable and rotatable, a transmission element, which is attached to the end of the shaft directed into the interior of the timepiece and which allows the drive of a timepiece part located in the interior of the timepiece, and also at least one resilient element, which exerts a preload force in the axial direction of the shaft. The invention also relates to a setting device, which has a holding and indexing device of this type, as well as to a timepiece comprising such a setting device.

BACKGROUND OF THE INVENTION

Setting units, in particular in the form of crowns fitted such that they can be rotated and/or pulled out, allow the setting of various movable component parts, which are located within the associated timepiece, for example, a date display, a world time disc, a moon disc, an inner bezel, which is common in particular with diving watches and which is used there to display the remaining diving time, or the like. Here, the setting is normally performed manually by the user of the timepiece, once the user has brought the setting unit into a corresponding position, which allows the setting, whereas the setting possibility is otherwise deactivated by disengagement. In the case of diving watches or other applications in which safety-relevant aspects play a role, automatically switching setting units, which can automatically perform the disengagement and engagement, are also known, for example from document EP 1 557 728.

The movable component part, preferably an inner bezel in the case of document EP 1 557 728, is secured here in the set position via a catch spring, which engages with corresponding notches, normally formed equidistantly on the movable component part. In addition, an indexing during the setting of the component part is achieved by the cooperation between catch spring and notches in so far as the user of the setting unit perceives the individual processes of engagement of the catch spring with each of the notches as individual steps of the setting process.

According to document WO2002/044818, the holding of the movable component part in the set position and also the indexing of the setting process can also be implemented via spring-loaded pins or leaf springs, which can engage with corresponding notches.

Another example of a setting unit is disclosed in document FR 1 602 849. The device described there allows the setting of an inner bezel, which is held in the set position by means of a corrugated leaf spring, which presses onto the inner bezel and produces a frictional force.

A setting unit, in this case a crown, is also proposed in document US2002/0167866 and allows the setting of an inner bezel. This is held in the set position by a part made of rubber-like material, which is provided between the bezel and the timepiece casing, that is to say by means of frictional force.

In the case of the previously known setting units, the holding of the movable component part in the set position and, where provided, the indexing of the setting process is/are therefore implemented via catch springs or pins cooperating with notches or via friction effects.

This is not always desirable, or even entails disadvantages for various reasons. For example, the spring force of the catch spring or the frictional force may not always be set with the necessary accuracy, for example due to manufacturing fluctuations or the structural design of the catch spring. In particular, the spring force of leaf springs allows less accurate setting than that of balance-springs. A catch spring furthermore causes an independent, additional engagement point at the periphery of the movable, settable component part, which may entail an increased spatial requirement and also, depending on the type of movable component and the parts otherwise still cooperating therewith, an increased complexity or limitation in terms of the design of the associated timepiece. Corresponding notches also have to be provided on the movable component part, which may be undesirable. In addition, only a very rough securing of the component part in the set position can be achieved by frictional forces alone, but no indexing of the setting process.

SUMMARY OF THE INVENTION

An object of the present invention is therefore to avoid the aforementioned disadvantages and to provide a holding and indexing device which holds the movable component part in the set position and also indexes the setting process in a reliable, structurally elegant, flexible and space-saving manner.

For this purpose, a subject of the present invention is characterized by the features specified in the characterizing part of claim 1.

In particular, a holding and indexing device according to the invention comprises an indexing ring, which is attached in an axially sliding manner on said shaft and which has an indexing toothing, and said transmission element comprises, on the side face thereof directed towards the indexing ring, a side toothing engaged with said indexing toothing as a result of the effect of the preload force of the resilient element, wherein application of a force of a predefined magnitude onto the indexing ring causes, in at least one direction of rotation of the shaft, a disengagement between the indexing toothing and the side toothing and thus allows a position indexing of said timepiece part.

Due to these measures, a range of advantages is attained. A holding and indexing device according to the present invention can thus be integrated directly into the associated setting device, whereby there is no additional spatial requirement at the periphery of the movable component part. The holding and indexing device may use a number of parts already provided in some setting devices and therefore constitutes a solution that is very interesting in terms of construction. In addition, both the securing of the movable component part in the set position and the indexing of the setting process can be implemented by the proposed solution. The device is robust and is characterized by a reliable functioning. The device can be integrated into a large number of setting devices and therefore in various timepieces without the need for significant changes there. These characteristics can be realised in a relatively simple manner in accordance with the present invention.

Further features and advantages will emerge from the dependent claims and also from the description presenting the invention in detail hereinafter by means of the accompanying figures.

BRIEF DESCRIPTION OF THE FIGURES

The accompanying figures by way of example illustrate a number of embodiments of a holding and indexing device according to the invention.

FIG. 1*c* shows a cross section of the holding and indexing device along the line I-I indicated in FIG. 1*b*, FIGS. 1*d*, 1*e* and 1*f* illustrate an exploded view of the holding and indexing device according to FIG. 1*a*, wherein

DETAILED DESCRIPTION OF THE INVENTION

Figure 1A:
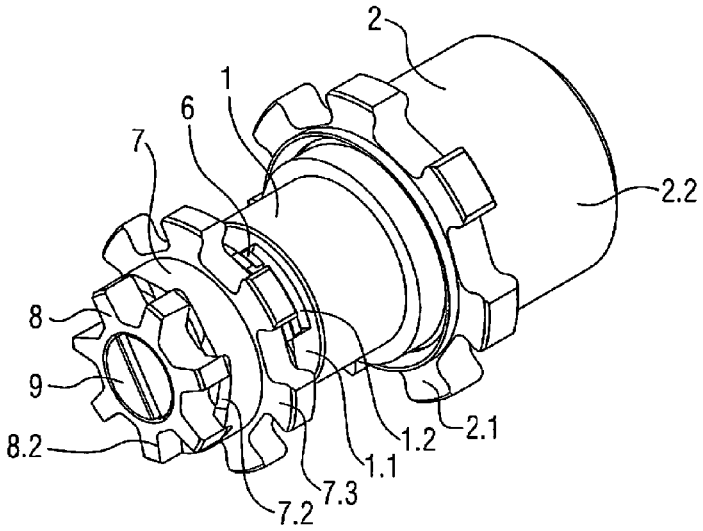
FIG. 1*a* illustrates a perspective view of a first embodiment of a holding and indexing device according to the present invention, wherein the device is in the normal position thereof.

The invention will now be described in detail hereinafter with reference to the figures.

A holding and indexing device according to the present invention is configured for integration in a setting device of timepieces, in particular of wristwatches. As can be seen from FIGS. 1*a*, 1*b* and 1*c* and also 1*d*, 1*e* and 1*f*, a holding and indexing device of this type has a bushing 1, which is fixedly attached in an opening of the casing of the timepiece in which the device is to be integrated. A shaft 3 is mounted within the bushing 1 so as to be both axially displaceable and rotatable, wherein the shaft 3 within the bushing 1 and at the end thereof directed into the interior of the timepiece has a shaft rod 3.1 of smaller diameter and at the end thereof directed toward the outer side of the timepiece has a shaft head of greater diameter, such that said shaft has a shaft shoulder 3.2 at the transition between shaft rod and shaft head. The device additionally has a transmission element 7, 8, which is attached to the end of the shaft rod 3.1 of the shaft 3 directed into the interior of the timepiece and which allows the drive of a timepiece part (not illustrated in FIGS. 1*a* to 1*f*) located in the interior of the timepiece, as well as at least one resilient element 4, which exerts a preload force acting in the axial direction of the shaft 3. It can be seen from FIG. 1*c* that the inner face of the bushing 1 at the end thereof directed into the interior of the timepiece has a bushing shoulder, against which preferably, but not necessarily, rests a packing ring 5. The resilient element 4 is formed as a balance-spring in the embodiment illustrated in FIGS. 1*a* to 1*f*, said balance-spring surrounding the shaft rod 3.1 and the ends of said balance-spring resting against the shaft shoulder 3.2, respectively the bushing shoulder of the bushing 1, such that the preload force of the balance-spring acts on the shaft 3 axially in the direction of the exterior of the timepiece due to the resting against the bushing shoulder fixedly attached in the timepiece casing.

The holding and indexing device is characterized in that it has an indexing ring 6, which is mounted on said shaft 3 in an axially sliding manner and which has an indexing toothing 6.1. The indexing ring 6 has a tubular portion 6.2, which is mounted slidingly in the bushing 1 in a manner surrounding the shaft rod 3.1. Here, the end of the tubular portion 6.2 directed towards the timepiece exterior terminates flush with said bushing shoulder in the normal position of the device, which is reproduced in FIGS. 1*a*, 1*b* and 1*c*, and therefore rests against the aforementioned packing ring 5, which is in turn pressed by the balance-spring 4 against the bushing shoulder of the bushing 1. However, this embodiment allows a sliding movement of the indexing ring 6 and therefore also of the packing ring 5 in the direction of the timepiece exterior, provided a force exceeding the preload force of the balance-spring 4 is applied for this purpose. In this context, it should be mentioned that the bushing 1, at the end directed into the interior of the timepiece, has a toothed end face, wherein the height of the end-face teeth 1.1 or the depth of the notches 1.2 between the end-face teeth 1.1 at said toothed end face is greater than the thickness of the indexing ring 6 and the associated indexing toothing 6.1. The indexing ring 6 is therefore attached to said shaft 3 in an axially sliding manner and is secured against rotation by engagement of the indexing toothing 6.1 of said indexing ring with said toothed end face of the bushing 1, wherein the stroke 6.3 of the axial movability corresponds to the difference between the height of the end-face teeth 1.1 and the thickness of the indexing ring 6.

At the same time, said transmission element 7, 8 has, on the side face thereof directed towards the indexing ring 6, a side toothing 7.1, which is engaged with said indexing toothing 6.1 due to the effect of the preload force of the resilient element, that is to say in the embodiment of FIGS. 1*a* to 1*f* due to the effect of the balance-spring 4. This is therefore the case, as explained above, in so far as the indexing ring 6 is preloaded via the tubular portion 6.2 thereof, which rests against the packing ring 5, by the spiral spring 4 in the direction of the interior of the timepiece and therefore in the direction of the side toothing 7.1, 8.1 of the transmission element 7, 8. The radial position of the side toothing 7.1 of the transmission element 7 is selected in accordance with the position of the indexing toothing 6.1 protruding radially beyond the bushing 1, so as to enable an engagement of both toothings. The indexing toothing 6.1 of the indexing ring 6 and the side toothing 7.1 of the transmission element 7, 8 are additionally formed in such a way that a disengagement between the indexing toothing 6.1 and the side toothing 7.1 is caused in at least one direction of rotation of the shaft 3 as a result of an application of a force of a predefined magnitude to the indexing ring 6, and a position indexing of said timepiece part 22 is thus allowed. Due to the accordingly selected length of the tubular portion 6.2, to the end of which directed into the interior of the timepiece the indexing toothing 6.1 is attached in a manner radially surrounding said portion, as well as due to the preload force of the balance-spring 4, the end of the indexing ring 6 directed into the interior of the timepiece, in particular the indexing toothing 6.1, in the normal position of the device protrudes slightly beyond the toothed end face of the bushing 1 and thus engages with the side toothing 7.1 of the transmission element 7, 8, wherein the indexing toothing 6.1 preferably also protrudes radially beyond the bushing 1, whereas, in the disengaged position of the device, the end of the indexing ring 6 directed into the interior of the timepiece, respectively the indexing toothing 6.1 terminates flush with the toothed end face of the bushing 1. The normal position of the device is illustrated by way of example in FIGS. 1*b* and 1*c*.

Generally, it should also be noted that the indexing toothing 6.1 of the indexing ring 6 may comprise markedly rectangular teeth, whereas the side toothing 7.1, 8.1 engaged with the indexing toothing 6.1, on the side face of said transmission element 7, 8 directed towards the indexing ring 6, consists of a first Breguet toothing 7.1 securing against any rotation in one direction of rotation or consists of similarly formed saw teeth or consists of a triangle toothing 8.1 allowing bidirectional rotation.

In the first embodiment of a holding and indexing device according to the present invention, which is illustrated in FIGS. 1*a* to 1*f*, the side toothing 7.1 engaged with the rectangular teeth of the indexing toothing 6.1, on the side face of said transmission element 7, 8 directed towards the indexing ring 6, consists of a first Breguet toothing 7.1 securing against any rotation in one direction of rotation.

Figure 1B:
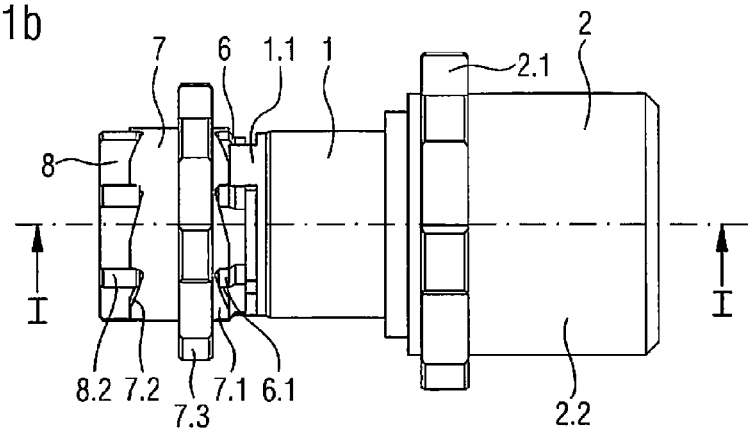
FIG. 1*b* illustrates a side view of the holding and indexing device according to FIG. 1*a*.
Figure 1C:
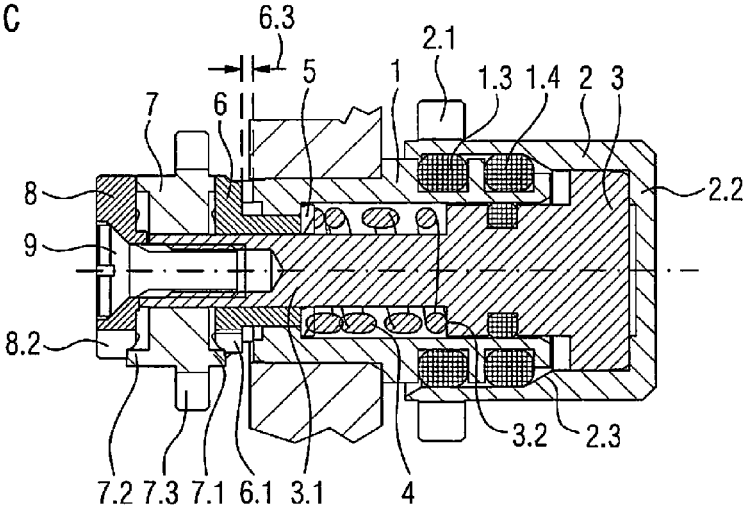
Figure 1D:
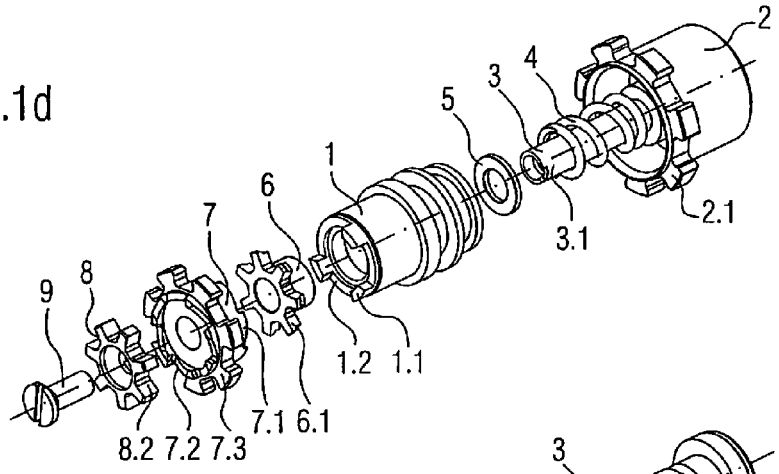
FIGS. 1*d* and 1*e* show the device respectively with and without an outer setting element from the side thereof facing the interior of the timepiece.
Figure 1E:
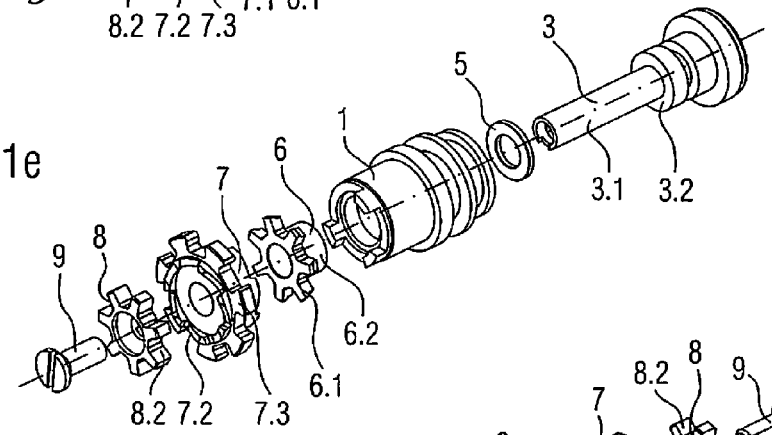
Figure 1F:
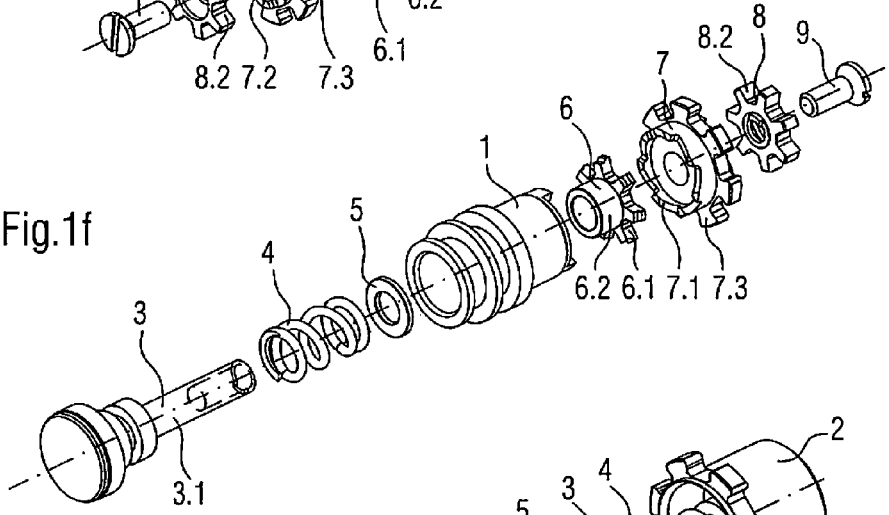
FIG. 1*f* shows the device without an outer setting element from the side thereof facing the outer side of the timepiece.

In this embodiment, the transmission element 7, 8 is formed in such a way that it has a carrier pinion 8 fixedly attached to the shaft 3 and a carrier disc 7 mounted rotatably about the shaft 3, as is clear in particular from FIGS. 1*c* and 1*d*. The carrier pinion 8 can be fastened to the end of the shaft rod 3.1 directed into the interior of the timepiece in particular by means of a conical screw 9. A coupling in the form of a second Breguet toothing 7.2 arranged on the side face of the carrier disc 7 directed towards the carrier pinion 8 and of a carrier toothing 8.2 on the carrier pinion 8 engaged with said second Breguet toothing 7.2 is provided between the carrier pinion 8 and the carrier disc 7. The side toothing 7.1, 8.1 engaged with the indexing toothing 6.1 on the side face of said transmission element 7, 8 directed towards the indexing ring thus consists in this case of a first Breguet toothing 7.1, which secures against any rotation in one direction of rotation and which is arranged on the side face of the carrier disc 7 directed towards the indexing ring 6.

The first 7.1 and second Breguet toothing 7.2 are arranged here on the carrier disc 7 such that, when the second Breguet toothing 7.2 of the carrier disc 7 and the carrier toothing 8.2 of the carrier pinion 8 mesh during the drive thereof in a direction of rotation, the first Breguet toothing 7.1 of the carrier disc 7 disengages, that is to say the saw teeth thereof slide over the indexing toothing 6.1 of the indexing ring since the torque exerted by the carrier pinion 8 via the carrier disc 7 onto the indexing ring 6 induces a force which displaces the indexing ring 6 by the stroke 6.3 in the direction of the timepiece exterior and compresses the balance-spring 4 against the preload force thereof. This allows an indexing during the setting process of the movable timepiece part 22.

Conversely, as the carrier pinion 8 is driven in the opposite direction of rotation, the carrier toothing 8.2 of the carrier pinion 8 slides over the second Breguet toothing 7.2 of the carrier disc 7, given that the shaft 3 is displaced in this case, due to the force produced by the torque in the axial direction against the preload force of the balance-spring 4 and by compression thereof in the direction of the interior of the timepiece, wherein the indexing toothing 6.1 of the indexing ring 6 latches into the first Breguet toothing 7.1 of the carrier disc 7 and thus secures the carrier disc 7 against any rotation in this direction of rotation. This allows a securing of the movable timepiece part 22 against any rotation in the direction corresponding to this direction of rotation of the carrier disc 7.

Figure 1G:
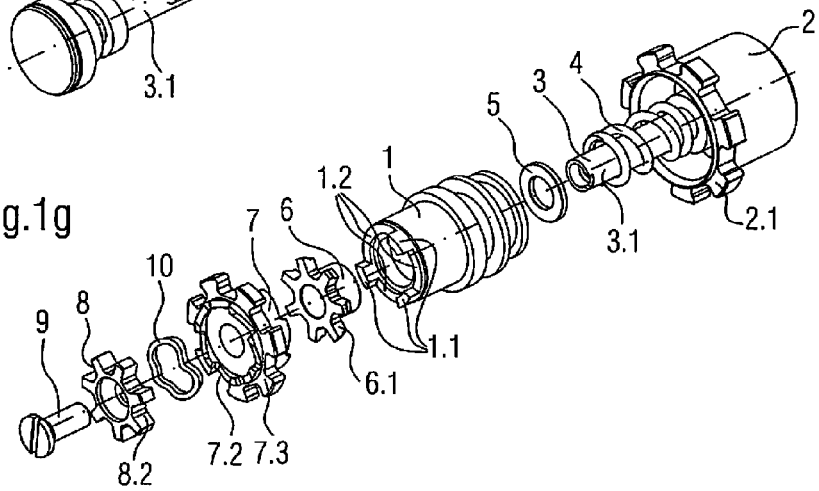
FIG. 1*g* shows a modified form of the first embodiment of the holding and indexing device according to the present invention with an outer setting element from the side thereof facing the interior of the timepiece.

In the context of the first embodiment of a holding and indexing device according to the present invention, it should also be mentioned, by referring to FIGS. 1*a* to 1*f*, that the above-mentioned at least one resilient element 4, 10, which exerts a preload force acting in the axial direction of the shaft 3, is formed here as a balance-spring 4 arranged between the shaft 3 and the indexing ring 6. According to FIG. 1*g*, which illustrates a variation of the first embodiment of the device, an annular expanding leaf spring 10 arranged between the shaft 3 and at least part of the transmission element 7, 8 can be provided as an additional resilient element, besides the balance-spring 4, in order to bias the carrier disc 7 effectively in the direction of the indexing ring 6. In particular, this expanding leaf spring 10 can be arranged between the carrier pinion 8, which is fixedly attached to the shaft 3, and the carrier disc 7 of the transmission element 7, 8. In other embodiments (not illustrated), it is also conceivable for the balance-spring 4 used in the first embodiment to be replaced completely by a suitably placed expanding leaf spring 10 of this type. The first embodiment of a holding and indexing device according to the present invention may comprise both resilient elements 4, 10. In any case, the preload force of the resilient element 4, 10 causes the indexing ring 6 and the transmission element 7, 8 to be loaded with respect to one another.

Figure 2A:
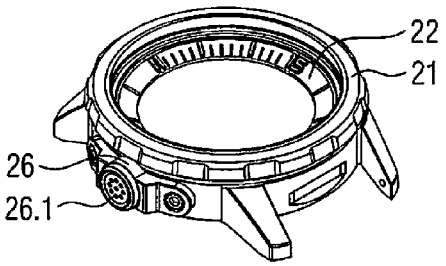
FIG. 2*a* shows schematically and by way of example a timepiece in perspective view, in which a holding and indexing device according to the first embodiment of the present invention is integrated.
Figure 2B:
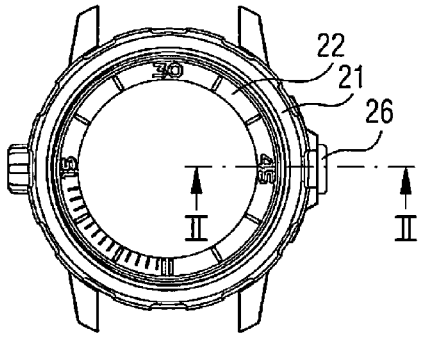
FIG. 2*b* is a plan view of the timepiece according to FIG. 2*a*, FIGS. 2*c* and 2*d* are cross sections of the holding and indexing device installed in the timepiece according to FIG. 2*a* along the line II-II indicated in FIG. 2*b*, wherein the associated setting device of the timepiece in FIG. 2*c* is located in the rest position thereof and in FIG. 2*d* is displaced slightly in the direction of the interior of the timepiece due to an automatic disengagement, and FIG. 2*e*, in an enlarged perspective view reproduced partly as a transparent illustration, shows an application of the first embodiment of the holding and indexing device according to the invention and of the associated setting device for setting an inner bezel of a timepiece.
Figure 2C:
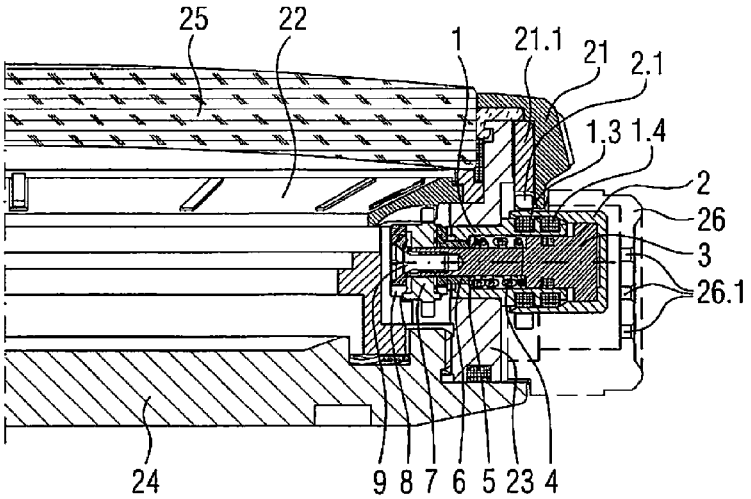
Figure 2D:
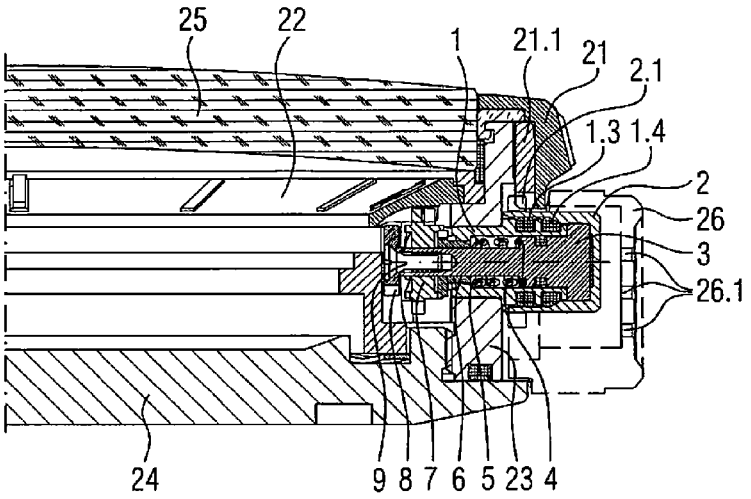

FIG. 2*a* shows schematically and by way of example a timepiece in perspective view, in which a holding and indexing device according to the above-described first embodiment of the present invention is integrated, and FIG. 2*b* is a plan view of the timepiece according to FIG. 2*a*. FIGS. 2*c* and 2*d* are cross sections of the holding and indexing device, integrated into the timepiece according to FIG. 2*a*, along the line II-II indicated in FIG. 2*b*, wherein the associated setting device of the timepiece is located in the rest position thereof in FIG. 2*c* and is displaced slightly in the direction of the interior of the timepiece in FIG. 2*d* due to an automatic disengagement. The setting device is used in this case, merely by way of example and for illustration of the invention, to set an inner bezel 22 via an outer bezel 21 arranged on the outer face of the casing of the timepiece, as is desirable for example in the case of diving watches. The outer bezel 21 and the inner bezel 22 are interconnected kinematically via the setting device.

In particular, the setting device, as can be seen primarily from FIGS. 2*c* and 2*d*, has an outer setting element 2, which is fixedly attached to the shaft 3 of the holding and indexing device and which allows the setting of said timepiece part 22. Furthermore, in the illustrated example, the outer setting element 2 is formed as a setting cap 2.2 with a drive toothing 2.1, which is engaged with a toothed rim 21.1 of an outer bezel 21 of the timepiece. If the user of the timepiece operates the setting element 2 via the outer bezel 21, the outer setting element 2 is protected against mechanical influences, preferably by means of a hood 26, wherein the hood 26, in the illustrated exemplary application of a diving watch, is provided with holes 26.1 for reasons that will become clear further below. The timepiece also has, as is conventional, a casing ring 23, in which the bushing 1 and also the further parts of the holding and indexing device according to the invention, respectively the associated setting device is fitted, as well as a casing back 24 and a watch glass 25 arranged above the inner bezel 22 and closing the interior of the timepiece.

In addition, the preload force of at least one resilient element 4, 10, preferably of the balance-spring 4, is determined in accordance with the effective end face of the setting element 2 in order to allow an automatic axial position switchover of the setting device in accordance with the external pressure applied, as presented with all details thereof in document EP 1 557 728, filed Nov. 5, 2004 and entitled AUTOMATIC CORRECTION DEVICE, which is hereby incorporated by reference in this regard into the present description. At least one ring seal 1.3, 1.4 is attached between the bushing 1 and the outer setting element 2 and cooperates with an associated chamfer 2.3 in such a way that, with an automatic, axial position switchover of the setting device in accordance with the external pressure applied, one of the ring seals 1.3, 1.4 is compressed in order to automatically increase the tightness, wherein the ring seals 1.3, 1.4 are preferably arranged on the outer face of the bushing 1 and the associated chamfer 2.3 is preferably arranged on the inner face of the setting element 2. An automatic, axial position switchover of the setting device in accordance with the external pressure applied as well as a simultaneous, automatic increase or decrease of the tightness of the setting device or of the associated timepiece is thus achieved due to the determination of the preload force of at least one resilient element 4, 10 in accordance with the effective end face of the setting element 2.

The functional principle of a holding and indexing device can be understood easily and clearly by means of FIG. 2*c*, which shows a cross section of the holding and indexing device installed in the timepiece along the line II-II indicated in FIG. 2*b*. The associated setting device of the timepiece is in FIG. 2*c* in its rest position, that is to say the coupling in the transmission element 7, 8 is in the engaged state. A rotation of the outer bezel 21 by the user of the timepiece in a clockwise direction thus turns the outer setting element 2, the shaft 3 and also the carrier pinion 8, as viewed from outside the timepiece, in an anticlockwise direction. As can be seen, for example, from FIG. 1*d*, this causes a latching between the second Breguet toothing 7.2 of the carrier disc 7 and the carrier toothing 8.2 of the carrier pinion 8, such that the carrier drive toothing 7.3, which engages with a toothed rim of the inner bezel 22, drives said inner bezel in a clockwise direction. At the same time, during the drive of the carrier pinion 8 in this direction of rotation, the first Breguet toothing 7.1 of the carrier disc 7 disengages from the indexing toothing 6.1 of the indexing ring 6, that is to say the sawtooth-shaped toothing thereof slides over the indexing toothing 6.1 of the indexing ring 6, since the torque exerted by the carrier pinion 8 via the carrier disc 7 onto the indexing ring 6 causes a force that displaces the indexing ring 6 by the stroke 6.3 in the direction of the exterior of the timepiece and compresses the spiral spring 4 against the preload force thereof. This allows an indexing during the setting process of the movable timepiece part 22. While the inner bezel 22 is located in a set position, that is to say as long as the outer bezel 21 is not actuated, this additionally allows a holding or a securing of the inner bezel, respectively in general of the movable timepiece part 22, in the set position.

Conversely, when the outer bezel 22 is rotated by the user of the timepiece in an anticlockwise direction, the outer setting element 2, the shaft 3 and also the carrier pinion 8, as considered from the timepiece exterior, are rotated in a clockwise direction. As can also be seen from FIG. 1*d*, this causes, during the drive of the carrier pinion 8 in this direction of rotation, a sliding of the carrier toothing 8.2 of the carrier pinion 8 over the second Breguet toothing 7.2 of the carrier disc 7, in so far as the shaft 3 is displaced here in an axial direction against the preload force of the spiral spring 4 and with compression thereof in the direction of the interior of the timepiece due to the force produced by the torque. At the same time, the indexing toothing 6.1 of the indexing ring 6 latches into the first Breguet toothing 7.1 of the carrier disc 7 and thus secures the carrier disc 7 and therefore the inner bezel 21 against any rotation in this direction of rotation. This generally allows a securing of the movable timepiece part 22 against any rotation in the direction corresponding to this direction of rotation of the outer bezel 22, of the outer setting element 2, or of the carrier pinion 8, which in the illustrated example corresponds to a securing of the inner bezel 21 against a rotation in an anticlockwise direction.

FIG. 2*d* shows a corresponding cross section of the holding and indexing device installed in the timepiece, respectively of the associated setting device, once the shaft 3 and therefore the carrier pinion 8 have been displaced slightly in the direction of the interior of the timepiece due to an automatic position switchover. The automatic switchover may occur due to the influence of the applied external pressure, which can act on the outer setting element 2 through the holes 26.1 in the hood 26, and takes place in a manner fully analogous to the explanations in document EP 1 557 728. As a result of this position switchover, the associated setting device of the timepiece is located in FIG. 2*d* in the switchover position thereof, that is to say the coupling in the transmission element 7, 8 is located in the disengaged state. The carrier toothing 8.2 of the carrier pinion 8 and the second Breguet toothing 7.2 of the carrier disc 7 are not in contact with one another in this switchover position, and a rotation of the outer bezel 22, or of the outer setting element 2, independently of the direction of rotation, does not lead to any displacement of the inner bezel 21. The inner bezel 22, and in general any movable timepiece part 22 settable via the setting device, is held or secured here in the pre-set position by the holding and indexing device as explained above.

Figure 2E:
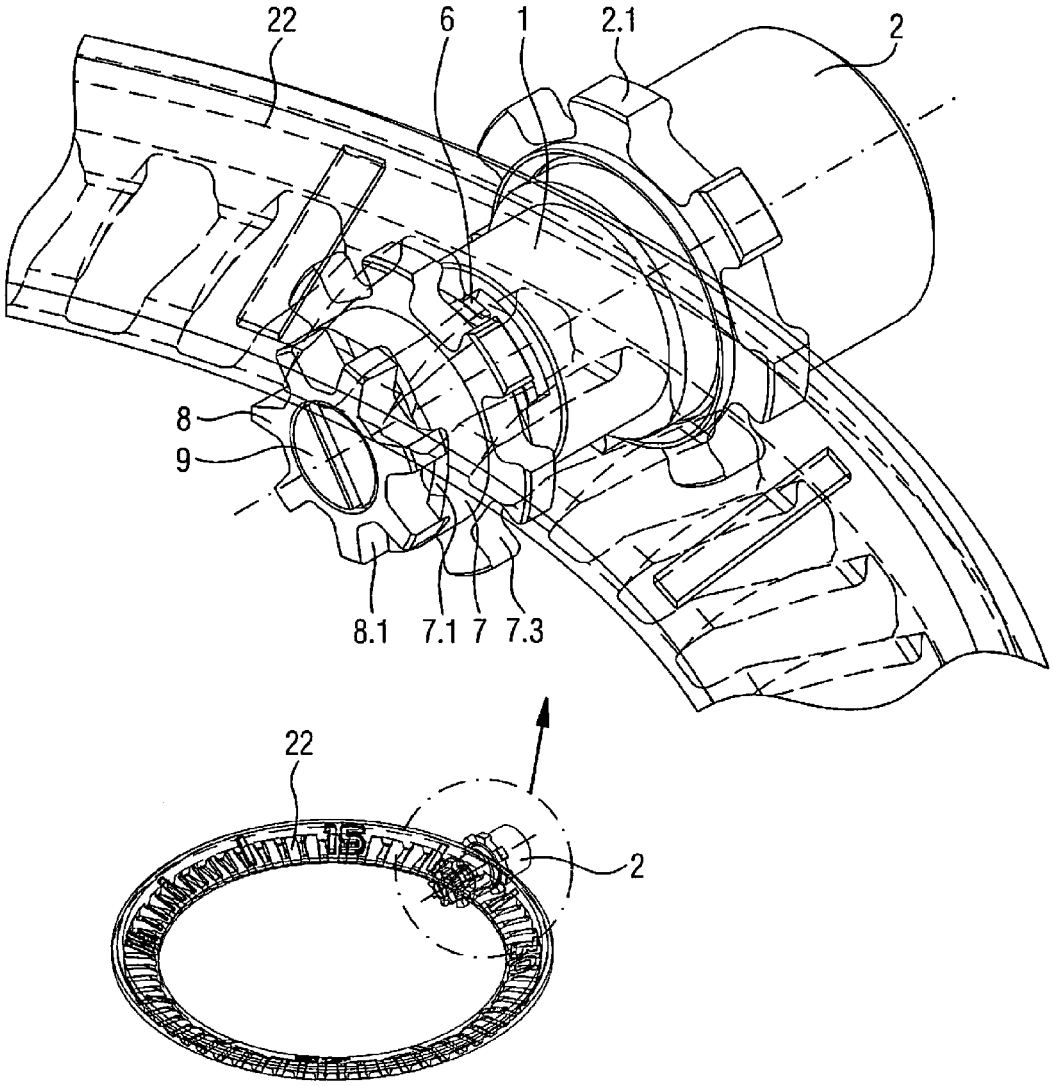

FIG. 2*e* shows the above-described application of the first embodiment of the holding and indexing device according to the invention, respectively of the associated setting device for setting an inner bezel 22 of a timepiece via the outer setting element 2 driven by an outer bezel 21 and formed as a setting cap 2.2 with a drive toothing 2.1 in an enlarged perspective view, reproduced partially as a transparent illustration. Here, the drive toothing 2.1 of the outer setting element 2 is engaged with a toothed rim 21.1 of the outer bezel 21 of the timepiece, wherein the latter can be rotated manually by the user of the timepiece. It is noted here that the carrier disc 7 in this case has been inserted into the device in the reverse direction as compared to FIGS. 1*a* to 1*g* and 2*a* to 2*d*. The direction of rotation of the outer bezel 21 that causes a setting of the inner bezel 22 and the direction in which the inner bezel 22 is secured against setting by the holding and indexing device can thus be swapped in a simple manner.

Figure 3A:
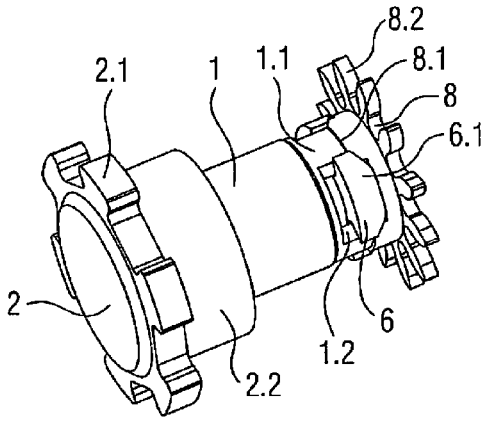
FIG. 3*a* shows a perspective view of a second embodiment of a holding and indexing device according to the present invention, wherein this device is located in the normal position thereof.
Figure 3B:
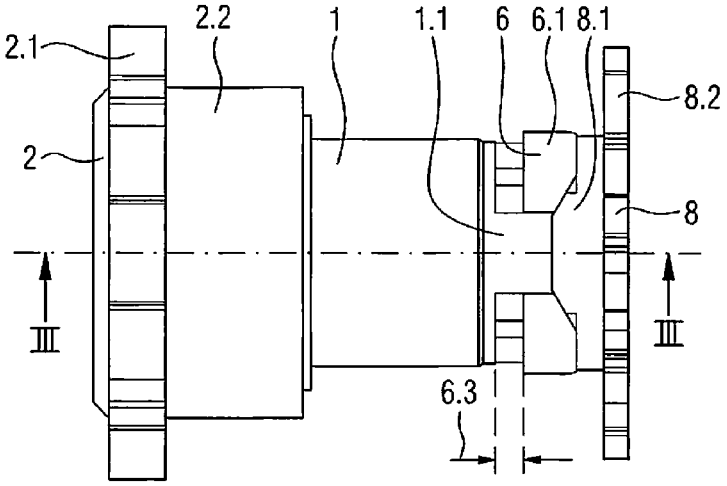
FIG. 3*b* illustrates a side view of the holding and indexing device according to FIG. 3*a*.
Figure 3C:
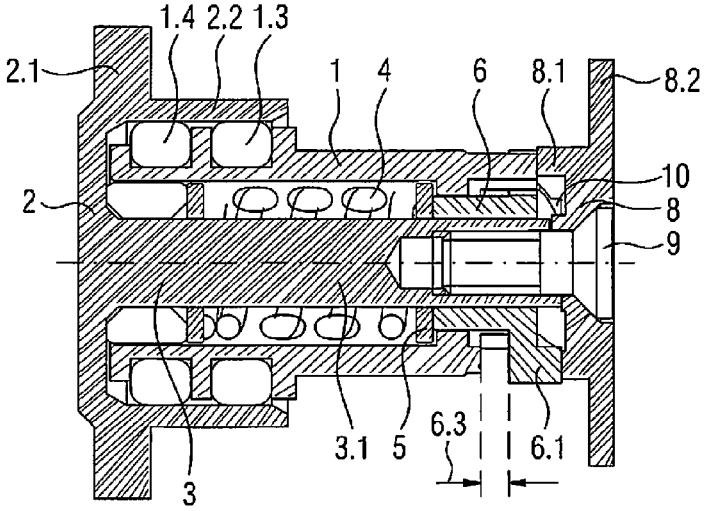
FIG. 3*c* shows a cross section of the holding and indexing device along the line III-III indicated in FIG. 3*b*.

FIG. 3*a* illustrates a perspective view of a second embodiment of a holding and indexing device according to the present invention, wherein this device is located in the normal position thereof. FIGS. 3*b* and 3*c* illustrate a side view of the holding and indexing device according to FIG. 3*a*, respectively a cross section of the device along the line III-III indicated in FIG. 3*b*. The holding and indexing device according to this second embodiment is constructed largely analogously in relation to the first embodiment, such that only the differences will be explained in greater detail hereinafter, whereas identical component parts and function thereof will not be described again. In the case of the holding and indexing device according to the second embodiment, the transmission element 7, 8 has only one carrier pinion 8 fixedly attached to the shaft 3, but no carrier disc 7, such that, in other words, the transmission element 7, 8 does not have a coupling. Accordingly, the shaft 3 of this holding and indexing device is not axially displaceable, such that the spiral spring 4 in this case is used only to control the axial displacement movement of the indexing ring 6, respectively to pre-load the indexing ring 6 in the direction of the interior of the timepiece and also of the carrier pinion 8.

Furthermore, the side toothing 7.1, 8.1 mentioned in the introduction and engaged with the indexing toothing 6.1, on the side face of said transmission element 7, 8 directed towards the indexing ring 6, consists in this embodiment of the device of a triangle toothing 8.1 arranged on the side face of the carrier pinion 8 directed towards the indexing ring 6 and allowing a bidirectional rotation, as can be seen for example from FIGS. 1*a* and 1*b*. The rectangular teeth of the indexing toothing 6.1 of the indexing ring 6 here likewise have a corresponding lateral chamfer.

The holding and indexing device according to the second embodiment functions analogously to the first embodiment, however, in the case of the second embodiment of the device, only a holding of the movable timepiece part 22 in the set position and an indexing during the setting process are sought and implemented, but no securing of the movable timepiece part 22 against a displacement in the event of rotation of the associated outer setting crown 2, respectively of the shaft 3 in a given direction of rotation. By contrast, it is possible with this device to set the movable timepiece part 22 by rotation of the associated outer setting crown 2, respectively of the shaft 3, in both directions of rotation.

It would, of course, also be possible in an alternative embodiment (not illustrated) to form the indexing toothing 6.1 as well as the side toothing 7.1, 8.1 engaging therewith of the device according to the second embodiment analogously to the device according to the first embodiment and, therefore, to likewise achieve a securing of the movable timepiece part 22 against a setting in the event of rotation of the associated outer setting crown 2, respectively of the shaft 3, in a given direction of rotation.

Conversely, the indexing toothing 6.1 as well as the side toothing 7.1, 8.1 engaged therewith of the device according to the first embodiment can be formed analogously to the device according to the second embodiment, such that an associated setting device with automatic position switchover could be actuated bidirectionally.

Figure 4A:
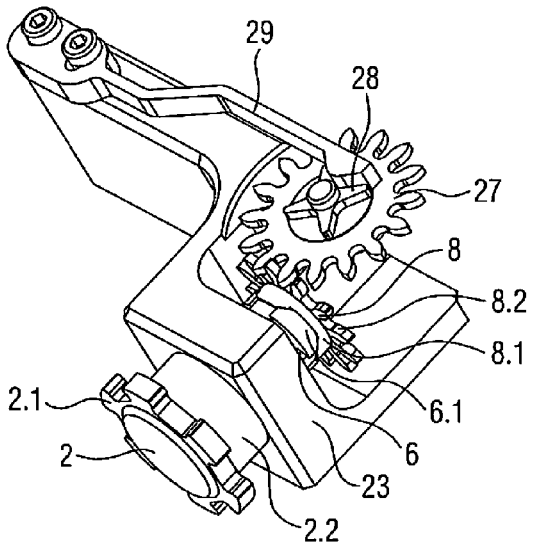
FIG. 4*a* shows schematically and by way of example a detail of a timepiece casing in a perspective view, in which a holding and indexing device according to the second embodiment of the present invention is integrated.
Figure 4B:
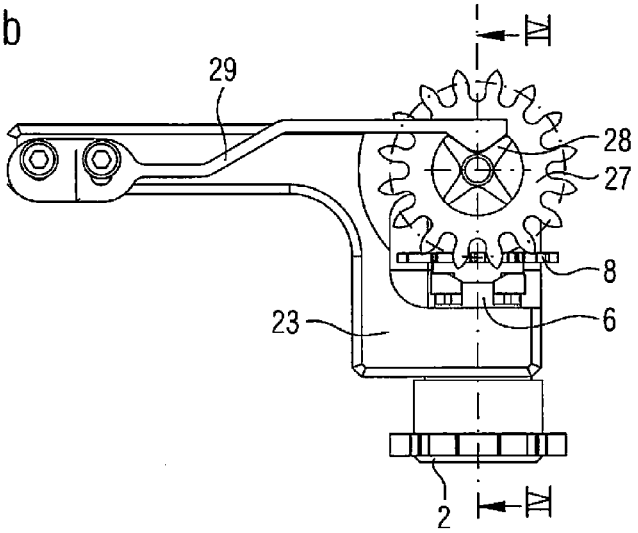
FIG. 4*b* is a partial plan view of the timepiece casing according to FIG. 4*a*.
Figure 4C:
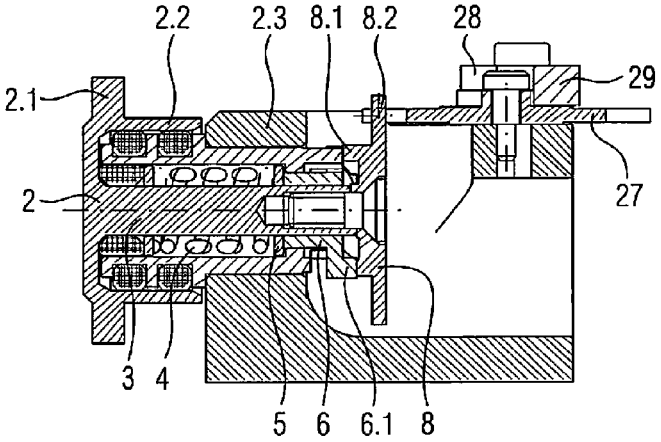
FIG. 4*c* is a cross section of the holding and indexing device installed in the timepiece casing according to FIG. 4*a* along the line IV-IV indicated in FIG. 4*b*, wherein the device is located in the normal position thereof.

FIG. 4*a* shows schematically and by way of example a detail of a timepiece casing in a perspective view, in which a holding and indexing device according to the second embodiment of the present invention, respectively an associated setting device, is integrated. FIGS. 4*b* and 4*c* are a partial plan view of the timepiece casing according to FIG. 4*a* and a cross section of the holding and indexing device installed in the timepiece casing according to FIG. 4*a* along the line IV-IV indicated in FIG. 4*b*, wherein the device is arranged in the normal position thereof. As can be seen from these figures, the holding and indexing device according to the second embodiment, similarly to the device according to the first embodiment, can be used to control or set almost any arbitrary timepiece part 22 in the interior of the timepiece as a result of the engagement between the carrier pinion 8 and a transmission wheel 27, which is in turn kinematically connected to said timepiece part 22. The transmission wheel 27 may optionally carry a holding star 28, with which a catch spring 29 engages. In this case, the preload force of the resilient element of the holding and indexing device can be lower, such that the device is used primarily for indexing.

Figure 4D:
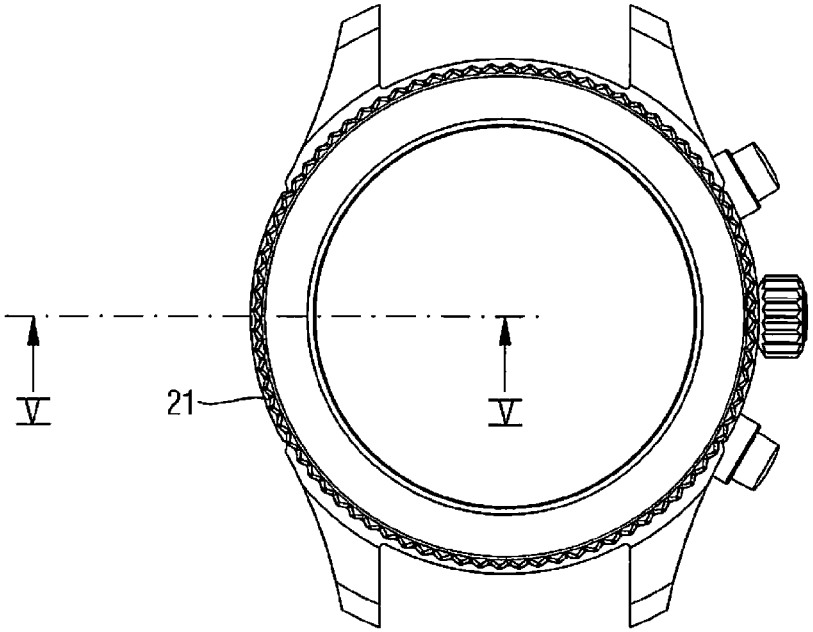
FIG. 4*d* is a plan view of a timepiece in which a holding and indexing device according to the second embodiment of the present invention is integrated.
Figure 4E:
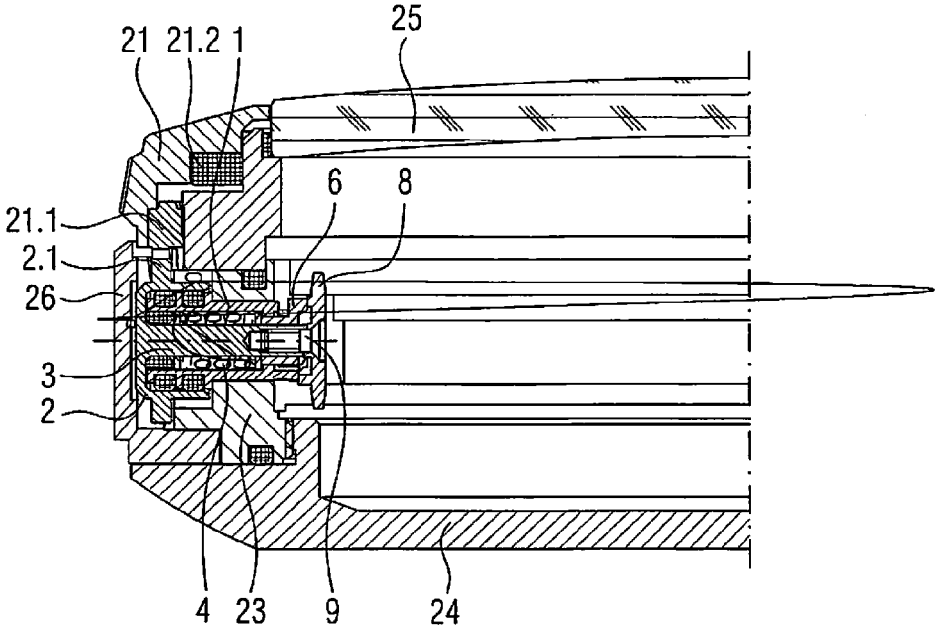
FIG. 4*e* is a partial cross section of the holding and indexing device installed in the timepiece according to FIG. 4*d* along the line V-V indicated in FIG. 4*d*, wherein the device is located in the normal position thereof.

FIGS. 4*d* and 4*e* illustrate a plan view of a timepiece, in which a previously described holding and indexing device according to the second embodiment of the present invention is integrated, as well as a partial cross section of this timepiece along the line V-V indicated in FIG. 4*d*, wherein the device is arranged in the normal position thereof. The setting device illustrated there and comprising the holding and indexing device according to the invention has an outer setting element 2 which is fixedly attached to the shaft 3 of the holding and indexing device and which allows the setting of a timepiece part 22 (not denoted in greater detail) in the interior of the timepiece. Here, the axial displaceability of the shaft 3 is prevented, as mentioned, for the above reasons, and the outer setting element 2 is operated by means of an outer bezel 21, similarly to the setting device illustrated in FIGS. 2*a* to 2*d*.

Although an actuation of the outer setting element 2 by means of an outer bezel 21 may be advantageous, it is however generally also possible for the outer setting element 2 of a setting device comprising a holding and indexing device according to the invention to be formed as a setting crown actuatable manually by a user of the timepiece.

The invention also relates to a timepiece which comprises a setting device with a holding and indexing device according to the invention, wherein the timepiece may comprise an outer bezel 21 or an outer crown, which serves to set said timepiece part 22 of the timepiece.

Incidentally, it is clear to a person skilled in the art in light of the above description that said movable timepiece part 22 of the timepiece, which is set by means of the setting device and of which the position is held and/or secured by means of the holding and indexing device and of which the position setting is indexed, is kinematically connected to said transmission element 7, 8 and may consist of a wide range of parts of a timepiece. In particular, this movable timepiece part 22 can be selected from the group comprising an inner bezel, a date disc, a world time disc, a moon disc, an alarm clock disc, a tachymeter disc, and an indexing pointer disc that can be used for various purposes, such that the invention is not limited to the examples explicitly illustrated.

A holding and indexing device of this type, respectively an associated setting device, is useful in particular in the case of diving watches, since in this case an inadvertent adjustment of the inner bezel 22, particularly in the direction in which the inner bezel 22 would display a longer diving time than is actually correct, would be significant for the safety of the diver and must be avoided. This is possible by means of a holding and indexing device according to the invention.

A holding and indexing device according to the present invention has a range of advantages and can be integrated for example directly into the associated setting device, whereby there is no additional spatial requirement at the periphery of the movable component part. In particular, the holding and indexing device may even utilize parts provided anyway in some setting devices and therefore constitutes a solution that is very interesting in terms of construction. In addition, as a result of the proposed solution, both the holding and the securing of the movable component part in the set position and the indexing of the setting process can be implemented by the proposed solution. The device is robust and is characterized by a reliable functioning. The device can be integrated in a large number of setting devices and therefore in various timepieces, without requiring significant changes thereto. In addition, this is implemented in a relatively simple manner in accordance with the present invention.

The invention claimed is:

1. A holding and indexing device for integration in a setting device of a timepiece, wherein the device comprises:

a bushing fixedly attached to a case of said timepiece, a shaft mounted within the bushing so as to be both axially displaceable and rotatable, a transmission element attached to an end of the shaft directed into an interior of the timepiece, and the transmission element allows a drive of a timepiece part located in the interior of the timepiece, and at least one resilient element exerting a preload force acting in the axial direction of the shaft, an indexing ring mounted on said shaft in an axially sliding manner and having an indexing toothing, wherein said transmission element comprises, on a side face thereof directed towards the indexing ring, a side toothing engaged with said indexing toothing due to an effect of the preload force of the resilient element, and wherein, in at least one direction of rotation of the shaft, an application of a force of a predefined magnitude onto the indexing ring causes a disengagement between the indexing toothing and the side toothing and thus allows a position indexing of said timepiece part.

2. The device according to claim 1, wherein the bushing, at the end directed into the interior of the timepiece, comprises a toothed end face, wherein a height of teeth at the end face is greater than a thickness of the indexing ring and the associated indexing toothing, such that the indexing ring is attached to said shaft in an axially sliding manner, as well as secured against rotation due to engagement of the indexing toothing with said toothed end face of the bushing, wherein a stroke of the axial movability corresponds to the difference between the height of the end-face teeth and the thickness of the indexing ring.

3. The device according to claim 1, wherein the indexing toothing of the indexing ring comprises rectangular teeth.

4. The device according to claim 1, wherein the side toothing engaged with the indexing toothing, on the side face of said transmission element directed towards the indexing ring, consists of a first Breguet toothing securing against any rotation in one direction of rotation or consists of a triangle toothing allowing a bidirectional rotation.

5. The device according to claim 1, wherein the transmission element comprises a carrier pinion fixedly attached to the shaft and a carrier disc rotatable about the shaft, between which a coupling in the form of a second Breguet toothing arranged on a side face of the carrier disc directed towards the carrier pinion in conjunction with a carrier toothing on the carrier pinion engaged with said second Breguet toothing is mounted, wherein the side toothing engaged with the indexing toothing, on the side face of said transmission element directed towards the indexing ring, consists of a first Breguet toothing on a side face of the carrier disc directed towards the indexing ring and securing against any rotation in one direction of rotation.

6. The device according to claim 1, wherein the transmission element comprises a carrier pinion fixedly attached to the shaft, wherein the side toothing engaged with the indexing toothing, on the side face of said transmission element directed towards the indexing ring, consists of a triangle toothing on a side face of the carrier pinion directed towards the indexing ring and allowing a bidirectional rotation.

7. The device according to claim 1, wherein at least one resilient element, which exerts a preload force acting in the axial direction of the shaft, is formed as a balance-spring arranged between the shaft and the indexing ring and/or as an annular expanding leaf spring arranged between the shaft and at least part of the transmission element, wherein the preload force of the resilient element loads the indexing ring and the transmission element with respect to one another.

8. A setting device for timepieces, wherein said setting device comprises a holding and indexing device according to claim 1, wherein the setting device comprises an outer setting element, which is fixedly attached to the shaft of the holding and indexing device and which allows a setting of said timepiece part, and the preload force of at least one resilient element is determined in accordance with an effective end face of the setting element in order to allow an automatic, axial position switchover of the setting device in accordance with the external pressure applied.

9. The setting device according to claim 8, wherein at least one ring seal is fitted between the bushing and the outer setting element and cooperates with an associated chamfer in such a way that, with an automatic, axial position switchover of the setting device depending on the external pressure applied, one of the ring seals is compressed in order to automatically increase the tightness, wherein the ring seals are arranged on an outer face of the bushing and the associated chamfer is arranged on the inner face of the setting element.

10. The setting device according to claim 8, wherein the outer setting element is formed as a setting cap with a drive toothing, which is engaged with a toothed rim of an outer bezel of the timepiece.

11. The setting device according to claim 8, wherein the outer setting element is formed as a setting crown manually actuatable by a user of the timepiece.

12. A timepiece, comprising a setting device according to claim 8, wherein the timepiece comprises an outer bezel which serves to set said timepiece part of the timepiece.

13. The timepiece according to claim 12, wherein said timepiece part of the timepiece, which is set by means of the setting device and of which the position is indexed by the holding and indexing device, is kinematically connected to said transmission element and is selected from the group containing an inner bezel, a date disc, a world time disc, a moon disc, an alarm clock disc, a tachymeter disc and an indexing pointer disc.

14. A timepiece, wherein said timepiece comprises a setting device according to claim 8, and wherein the timepiece has an outer crown which serves to set said timepiece part of the timepiece.

15. A setting device for timepieces, comprising a holding and indexing device according to claim 1, wherein the setting device comprises an outer setting element which is fixedly attached to the shaft of the holding and indexing device and which allows a setting of said timepiece part, and wherein an axial displaceability of the shaft is prevented.

16. The setting device according to claim 15, wherein the outer setting element is formed as a setting cap with a drive toothing, which is engaged with a toothed rim of an outer bezel of the timepiece.

17. The setting device according to claim 15, wherein the outer setting element is formed as a setting crown manually actuatable by a user of the timepiece.

18. A timepiece, comprising a setting device according to claim 15, wherein the timepiece comprises an outer bezel which serves to set said timepiece part of the timepiece.

19. The timepiece according to claim 18, wherein the timepiece comprises a diving watch.

20. A timepiece, wherein said timepiece comprises a setting device according to claim 15, and wherein the timepiece has an outer crown which serves to set said timepiece part of the timepiece.

21. The timepiece according to claim 20, wherein said timepiece part of the timepiece, which is set by means of the setting device and of which the position is indexed by the holding and indexing device, is kinematically connected to said transmission element and is selected from the group containing an inner bezel, a date disc, a world time disc, a moon disc, an alarm clock disc, a tachymeter disc and an indexing pointer disc.

22. The holding and indexing device of claim 1, wherein the device is configured to be integrated into a setting device of a timepiece comprising a wristwatch.

* * * * *